United States Patent [19]

Ikeda et al.

[11] Patent Number: 4,593,535

[45] Date of Patent: Jun. 10, 1986

[54] DIFFERENTIAL PRESSURE VALVE

[75] Inventors: Tadaaki Ikeda, Sayama; Masakazu Kitamura, Hidakamachi; Tomoo Okada, Sakado, all of Japan

[73] Assignee: Kabushiki Kaisha Saginomiya Seisakusho, Tokyo, Japan

[21] Appl. No.: 686,877

[22] Filed: Dec. 27, 1984

[30] Foreign Application Priority Data

Dec. 28, 1983 [JP] Japan ..... 58-245325
Aug. 16, 1984 [JP] Japan ..... 59-124384[U]

[51] Int. Cl.[4] ..... F25B 41/04
[52] U.S. Cl. ..... 62/217; 137/87
[58] Field of Search ..... 62/217, 498; 137/87

[56] References Cited

U.S. PATENT DOCUMENTS 3,855,836 12/1974 Takahashi et al. ..... 62/217
3,858,406 1/1975 Izumi ..... 62/217 X
4,476,691 10/1984 Ozu ..... 62/217
4,531,378 7/1985 Nishi et al. ..... 62/217

*Primary Examiner*—William E. Tapolcai
*Attorney, Agent, or Firm*—Armstrong, Nikaido, Marmelstein & Kubovcik

[57] ABSTRACT

A pressure differential valve connected to a refrigerating circuit piping which, when a refrigerating cycle stops, blocks the high pressure coolant from diffusing into the low pressure section. Said pressure differential valve comprises a valve body having a first inlet, a first outlet, a second inlet and a second outlet; a valve disk installed in a valve chamber between the first inlet and the first outlet to open or close the passage between the first inlet and outlet, the valve disk being urged to open by a spring; a diaphragm installed between the second inlet and the second outlet to form pressure chambers; and a check valve secured to the diaphragm and communicating to both of the pressure chambers; whereby when the check valve is closed, the diaphragm causes, through a connecting rod, the valve disk to close. Said valve disk has radially projecting guide vanes attached to the axially extending portion of the seat-contacting disk to form spaces through which coolant can flow.

4 Claims, 6 Drawing Figures

DIFFERENTIAL PRESSURE VALVE

BACKGROUND OF THE INVENTION

The present invention relates to a refrigerating apparatus with reduced restarting load and more particularly to an improvement in a differential pressure valve which, when a compressor is stopped, is rapidly actuated to block the circuit and thereby prevent condensed coolant from flowing into the evaporator.

Improvement in power efficiency of the refrigerator is achieved by balancing the cooling medium pressure before and after the compressor when the compressor is stopped and by blocking the flow of condensed medium into the evaporator while at the same time keeping the high pressure of the condensed medium in the condensor, in order to reduce the restarting load.

For this purpose, it has been the common practice to provide a solenoid valve between the condensor and the capillary tube, which is operated by the compressor operation signal in such a way that it is opened during operation of the compressor and closed while in halt. With refrigerators which are usually used continuously for many hours, however, it is desirable to eliminate the use of solenoid valve even if the power consumption of the solenoid valve is small. It has often been pointed out that the solenoid valve operation can be noisy depending on the location of the refrigerator.

In recent years, therefore, a technology has been developed that employs a pressure valve in place of the solenoid valve.

FIG. 1 shows an example of the refrigerating apparatus that uses such a differential pressure valve. In this example, a rotary compressor A, a condenser B, a capillary tube C, and an evaporator D are connected in series by a pipe E; a differential pressure valve V1 is installed on the pipe E between the condenser B and the capillary tube C; a check valve V2 is installed between the evaporator D and the rotary compressor A; a pressure introducing tube F1 is connected between the suction side of the rotary compressor A after the check valve V2 and the differential pressure valve V1; and another pressure introducing tube F2 is connected to the outlet of the evaporator D before the check valve V2 and the differential pressure valve V1.

The differential pressure valve V1 has a primary port 2 and a secondary port 3 formed in its body 1. Between these ports is formed a valve seat 4 with which a ball 5 comes into or out of contact. Mounted at the lower part of the valve body 1 is a diaphragm 8 which is supported at its periphery by covers 6 and 7. A pressure chamber is formed in the cover 6 and is communicated with the pressure introducing pipe F1. A valve rod 9 is abutted, through a contact metal 16, against the upper side of the diaphragm 8. A spring 15 is installed between the valve rod 9 and the valve body 1. In the illustrated example, a spring retainer 14 mounted on the top of the valve rod 9 keeps the spring 15 in position and also holds the ball 5. The valve rod 9 passes through a packing housing 11 installed between it and the valve body 1 and is sealed by a seal packing 10. To keep the seal packing 10 in position, a packing retainer is pushed down by a leaf spring 13. The pressure introducing tube F2 is communicated with the pressure chamber in the cover 7 on the upper side of the diaphragm 8. To the primary port 2 is connected a pipe E1 coming from the condenser B; and to the secondary port 3 is connected a pipe E2 leading to the capillary tube C.

In the above construction, while the rotary compressor A is in operation, the pressure before and after the check valve V2 is almost equal and low. These pressures are introduced through the pressure introducing tubes F1 and F2 into each side of the diaphragm 8, and the ball 5 is parted by the spring 15 from the valve seat 4 to allow the coolant to flow into the capillary tube C.

Next, when the rotary compressor A is stopped, the high pressure on the delivery side leaks into the suction side so that the pressure on the suction side increases. However, the pressure leak into the suction side is blocked by the check valve V2, so the increased pressure is introduced through the pressure introducing tube F1 to the lower side of the diaphragm. The high pressure thus introduced pushes up the ball 5 against the low pressure on the upper side of the diaphragm 8 and the spring 15 to cut off the coolant flow to the capillary tube C.

In this construction, however, since the differential pressure valve and the check valve are installed separate, it is necessary to provide two pressure introducing tubes running from points before and after the check valve to the pressure differential valve, thereby complicating the circuit and also the piping work that involves brazing.

SUMMARY OF THE INVENTION

The present invention has been accomplished to overcome these drawbacks and provides a differential pressure valve with a built-in check valve used in a refrigerating circuit providing refrigerant flow path starting from a rotary compressor, passing through a condenser, an evaporator, and back to said rotary compressor comprising valve body means having a first inlet communicating with a condenser, a first outlet communicating with an evaporator, a second inlet communicating with the evaporator and a second outlet communicating with a rotary compressor; said first inlet and first outlet normally communicating with each other, said second inlet and second outlet normally communicating with each other;

valve means provided between said first inlet and first outlet;

a diaphragm extended between said second inlet and said second outlet, said diaphragm having a center hole;

a check valve attached to the diaphragm at said center hole;

a valve rod having a first end in abutment against said diaphragm on an inlet side thereof and a second end in abutment against said valve means, said valve means normally urged to provided the communication between said first inlet and said first outlet.

BRIEF DESCRIPTION OF THE DRAWINGS

FIG. 4*a* to FIG. 4*c* show a valve disk of the check valve, of which FIG. 4*a* is a front view, FIG. 4*b* is a side view and FIG. 4*c* is a back view.

DETAILED DESCRIPTION OF THE EMBODIMENTS

Figure 1:
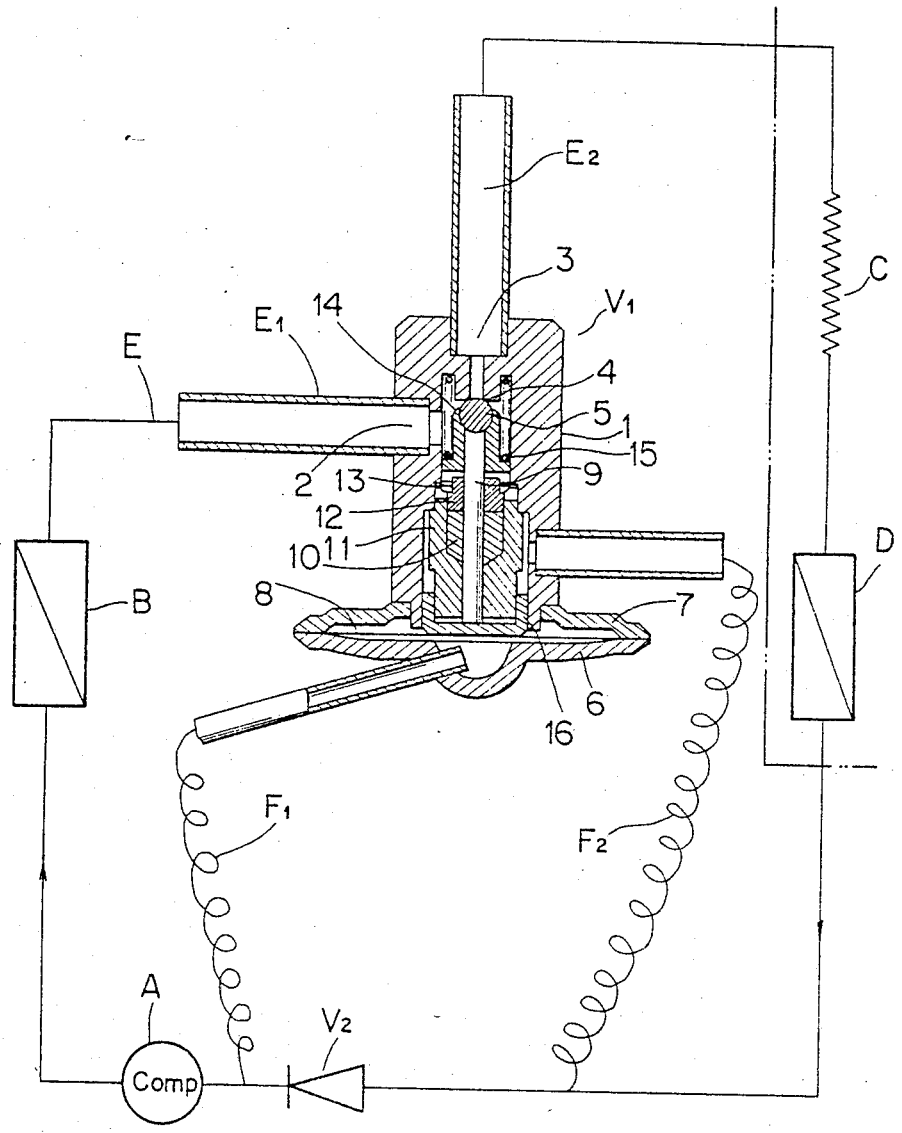
FIG. 1 is an explanatory drawing of the conventional differential pressure valve.
Figure 2:
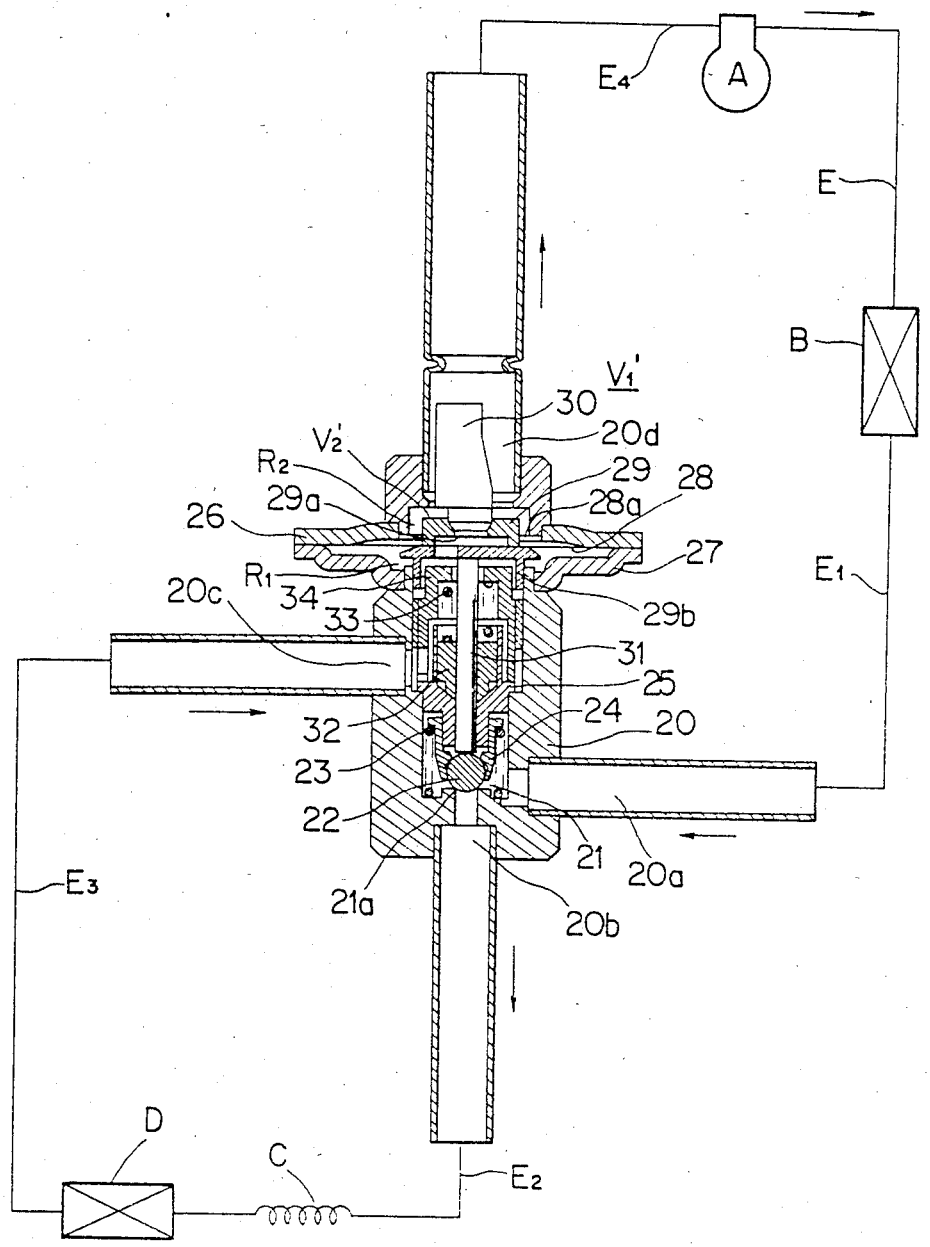
FIG. 2 is an explanatory drawing of one embodiment of the present invention.

FIG. 2 shows one embodiment of this invention, in which a rotary compressor A, a condenser B, a capillary tube C, an evaporator D, and a differential pressure valve V1' are connected in series by a pipe E.

The differential pressure valve V1' has a first inlet 20*a*, first outlet 20*b*, second inlet 20*c* and second outlet 20*d* formed in its body 20. The first inlet 20*a* is connected to the outlet of the condenser B by a pipe E1; the first outlet 20*b* is connected to the inlet of the capillary tube C by pipe E2; the second inlet 20*c* is connected to the outlet of the evaporator D by pipe E3; and the second outlet 20*d* is connected to the inlet of the rotary compressor A through pipe E4.

Formed in the valve chamber 21 between the first inlet 20*a* and the first outlet 20*b* is a valve seat 21*a* with which a ball 22 comes into or out of contact. The ball 22 is held by a retainer 24 for spring 23, the spring being installed between the valve body 20 and the retainer 24. The ball 22 is urged by the spring 23 to part from the valve seat 21. The spring retainer 24 is fitted over the packing housing 25 so that it is slidable relative to the housing 25.

At the other end of the valve body 20 is mounted a metallic diaphragm 28 which is held at its periphery by upper and lower covers 26, 27. On each side of the diaphragm 28 are formed pressure chambers R1 and R2, the pressure chamber R1 being communicated with the second inlet 20*c* and the pressure chamber R2 with the second outlet 20*d*.

A check valve V2' is secured, by ring projection welding, to the diaphragm 28 through a center hole 28*a*. The valve seat member 29 is disposed in the pressure chamber R2 and has a valve body 30 which comes into or out of contact with the valve seat 29*a*. The valve seat member 29 extends into the pressure chamber R1 to form a cylinder 29*b* which is slidable relative to the valve body 20.

A connecting rod 31 is provided between the valve seat member 29 secured to the diaphragm 28 and the ball 22. Designated 32 is a seal packing which is pressed by a spring 33 against the packing housing 25. Denoted 34 is a packing bolt.

In the above construction, when the rotary compressor A is in operation, the pressure chambers R1 and R2 have almost equal pressures so that the ball 22 is opened by the spring 23 permitting the coolant to flow as indicated by the arrow.

Next when the rotary compressor A is stopped, the coolant flows back closing the check valve V2', which in turn causes the pressure in the pressure chamber R2 to increase until it pushes down the diaphragm when the pressure of the chamber R2 is greater than the sum of the pressure of the chamber R1 and the force of spring 23. Downward deflection of the diaphragm 28 causes, through the connecting rod 31, the ball 22 to close thus preventing the high temperature coolant gas from flowing to the heat exchanger. In this way the pressure difference is maintained.

Figure 3:
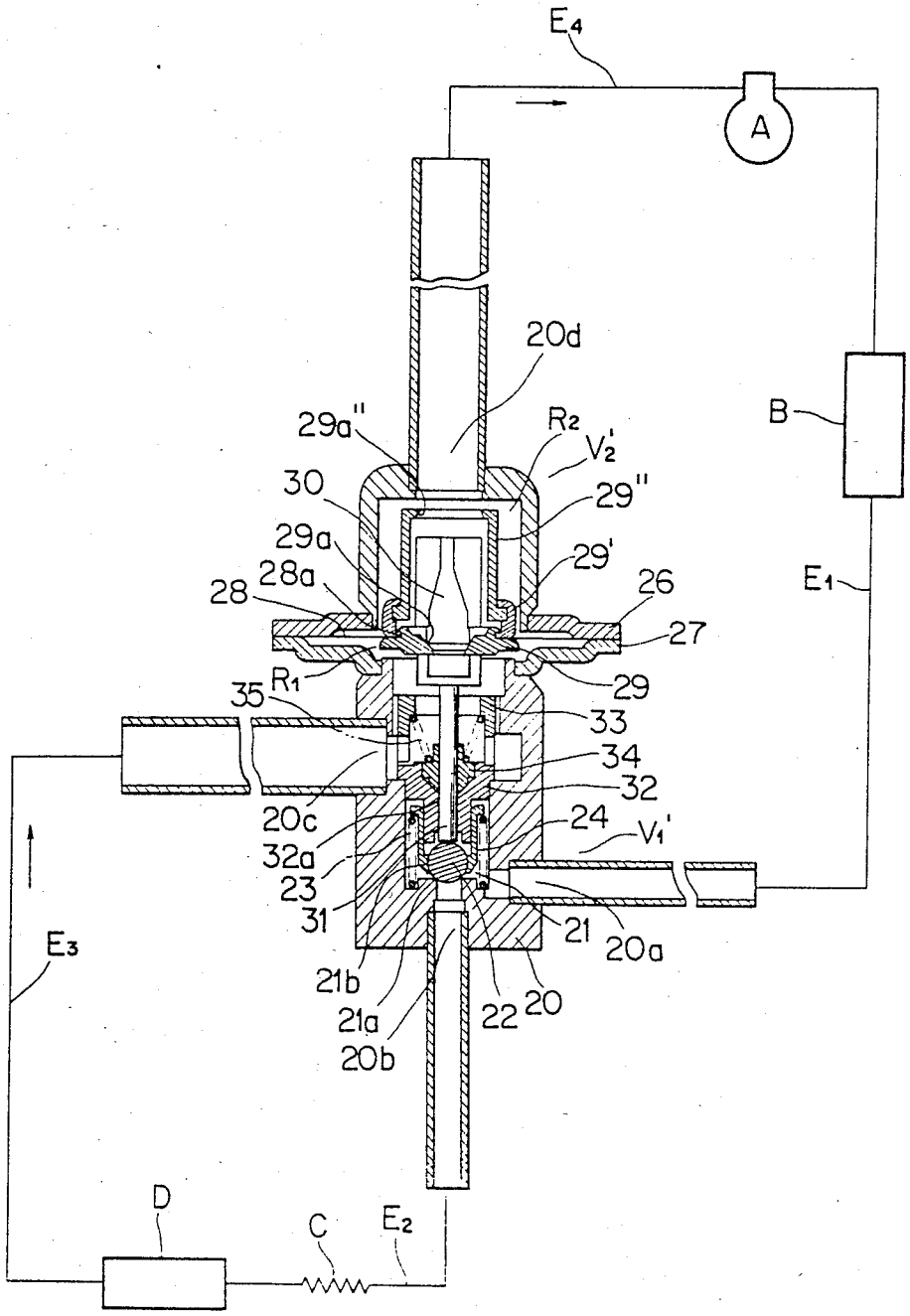
FIG. 3 is a cross section of another embodiment of the invention.
Figure 4A:
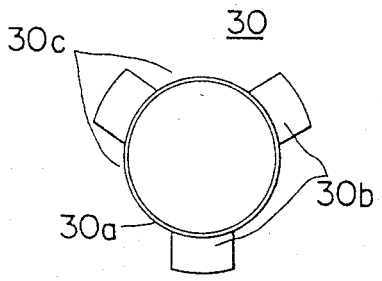
Figure 4B:
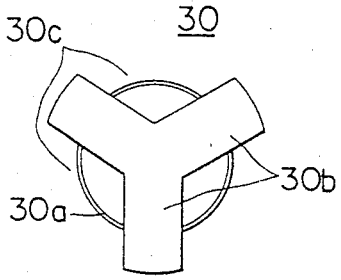
Figure 4C:
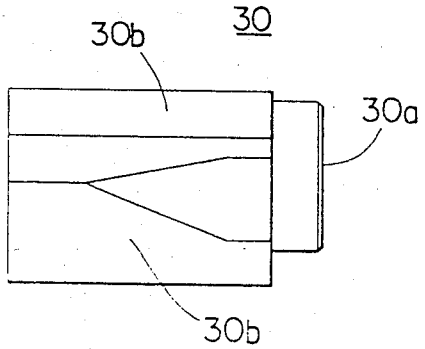

FIG. 3 shows another embodiment of this invention, in which a rotary compressor A, a condenser B, a capillary tube C, an evaporator D and a differential pressure valve V1' are connected in series by a pipe E.

The differential pressure valve V1' has a first inlet 20*a*, a first outlet 20*b*, a second inlet 20*c* and a second outlet 20*d* formed in its body 20. The first inlet 20*a* is connected through pipe E1 to the outlet of the condenser B; the first outlet 20*b* is connected through pipe E2 to the inlet of the capillary tube C; the second inlet 20*c* is connected to the outlet of the evaporator D through pipe E3; and the second outlet 20*d* is connected to the inlet of the rotary compressor A through pipe E4.

In the valve chamber 21 between the first inlet 20*a* and the first outlet 20*b* is formed a valve seat 21*a* on the side of the first outlet 20*b*, with which a ball 22 comes into or out of contact. The ball 22 is held by the spring retainer 24 which is urged in such a direction as to part from the valve seat 21 by a spring 23 installed between the valve body 20 and the retainer 24.

On the other end of the valve body 20 is mounted a metallic diaphragm 28 which is supported at its periphery by upper and lower covers 26, 27. On each side of the diaphragm are formed pressure chambers R1 and R2, the pressure chamber R1 being communicated to the second inlet 20*c* and the other pressure chamber R2 to the second outlet 20*d*.

A check valve V2' is provided to the diaphragm 28 through its center hole 28*a*. The valve seat member 29 is installed in the pressure chamber R1 and is securely coupled with a guide receptor 29' in the pressure chamber R2 through caulking connection. The guide receptor 29' sustains a guide cylinder 29'' in which is disposed a valve member 30' made of synthetic resin which comes into or out of contact with the valve seat 29*a* formed in the passage opening to the pressure chambers R1 and R2. At the end of the guide cylinder 29'' is formed a stopper 29*a*'' that prevents the synthetic resin valve member 30' from escaping from the cylinder 29''.

A valve rod 31 is provided between the valve seat member 29 and the ball 22. Designated 32 is a dividing member installed between the valve chamber 21 and the diaphragm 28 as a pressure responding member. The dividing member 32 has a guide hole 32*a* at the center for the valve rod 31. At the end of the guide hole 32*a* facing the valve chamber 21 is formed a valve seat 21*b* opposite to the valve seat 21*a*. Said valve seat 21*b* is a concave having a shape to snugly receive the ball 22 such that refrigerant leaking through the guide hole 32*a* is sealed by the ball when in the valve closed position. The dividing member 32 is fixed by bolt 33. Denoted 34 is a packing which is pressed by seal spring 35 against the dividing member 32.

In the check valve V2', the valve member has an axially extending portion of cylindrical seat-contacting part 30*a* provided with equidistantly spaced, radially projecting guide vanes 30*b* to form spaces 30*c* between the vanes through which coolant can flow. Said valve member 30', said cylindrical seat contacting part 30*a* and said guide vanes 30*b* are integrally formed of synthetic resin.

In the above construction, when the rotary compressor A is operating, the pressures in the pressure chambers Ra and R2 are almost equal so that the spring 23 opens the ball 22 allowing the coolant to flow in the direction as indicated by the arrow.

Next, when the rotary compressor A is stopped, the coolant flows back closing the check valve V2', which in turn increases pressure in the pressure chamber R2. When the pressure in the pressure chamber R2 is greater than the sum of the pressure in the pressure chamber R1 and the force of the spring 23, the diaphragm 28 deflects downward, pushing down the valve rod 31 and the ball 22 to close the valve seat 31*a* and thereby block the high temperature coolant gas from flowing into the heat exchanger. In this way the pressure difference is maintained.

In the check valve V2′ the valve member 30′ moves through the guide cylinder 29″. At this time since the member 30′ has the radially projecting guide vanes **30*b*, the disk moves stably through the cylinder 29″ without making any noise that may otherwise be caused by vibration. The guide vanes 30*b*** ensure a predetermined flow of the coolant.

In this invention, since the check valve is incorporated into the differential pressure valve, the piping construction of the refrigerating equipment can be simplified. Also, since the valve disk of the check valve is formed of synthetic resin, the impact noise of the disk operation and vibratory noise can be reduced and at the same time a predetermined flow of coolant in the forward direction is assured.

What is claimed is:

1. A differential pressure valve used in a refrigerating circuit providing refrigerant flow path starting from a rotary compressor, passing through a condenser, an evaporator, and back to said rotary compressor comprising valve body means having a first inlet communicating with a condenser, a first outlet communicating with an evaporator, a second inlet communicating with the evaporator and a second outlet communicating with a rotary compressor; said first inlet and first outlet normally communicating with each other, said second inlet and second outlet normally communicating with each other;

valve means provided between said first inlet and first outlet;

a diaphragm extended between said second inlet and said second outlet, said diaphragm having a center hole;

a check valve attached to the diaphragm at said center hole;

a valve rod having a first end in abutment against said diaphragm on an inlet side thereof and a second end in abutment against said valve means, said valve means normally urged to provided the communication between said first inlet and said first outlet.

2. A differential pressure valve according to claim 1, wherein said check valve includes a valve seat member attached to the diaphragm and having a valve seat formed therein on an outlet side thereof and a valve member positioned to rest on said valve seat.

3. A differential pressure valve according to claim 2, wherein said check valve further including a guide cylinder extending to open to said valve seat member at a first end thereof and to said second outlet at a second end thereof such that said guide cylinder encloses the valve member, said valve member having guide vanes radially extending therearound to define a plurality of communication spaces therebetween.

4. A differential pressure valve according to claim 3, wherein said valve member and guide vanes are made of synthetic resin.

* * * * *